US005978971A

United States Patent [19]

Wald

[11] Patent Number: 5,978,971

[45] Date of Patent: Nov. 9, 1999

[54] MALE BOXER SHORTS WITH INTEGRATED MALE BRIEFS

[75] Inventor: Robert A. Wald, Toluca Lake, Calif.

[73] Assignee: Wald Cranfill, LLC, Toluca Lake, Calif.

[21] Appl. No.: 08/914,395

[22] Filed: Aug. 19, 1997

Related U.S. Application Data

[60] Provisional application No. 60/028,130, Oct. 15, 1996.

[51] Int. Cl.[6] ..... A41D 1/06

[52] U.S. Cl. ..... 2/403; 2/400; 2/227

[58] Field of Search ..... 2/400–407, 227, 2/228, 238, 78.1, 79

[56] References Cited

U.S. PATENT DOCUMENTS

| | | | |
|---|---|---|---|
| 2,034,312 | 3/1936 | Rubin | 2/238 |
| 2,446,326 | 8/1948 | Guithues . | |
| 2,599,769 | 6/1952 | MacRae et al. . | |
| 2,983,924 | 5/1961 | Cohen et al. . | |
| 4,223,408 | 9/1980 | Sullivan . | |
| 5,052,058 | 10/1991 | Mueller . | |
| 5,379,462 | 1/1995 | Morgan et al. . | |
| 5,598,586 | 2/1997 | Munjone . | |

*Primary Examiner*—Gloria Hale

*Attorney, Agent, or Firm*—Jeffer, Mangels, Butler & Marmaro LLP

[57] ABSTRACT

Boxer shorts for men having internal integrated male briefs not visible from the exterior. The briefs are sewn inside the shorts and both are integrated with a single waistband. The look of boxer shorts is provided with the added benefit of built-in invisible male briefs for supporting the male anatomy.

6 Claims, 2 Drawing Sheets

MALE BOXER SHORTS WITH INTEGRATED MALE BRIEFS

CROSS-REFERENCE TO RELATED APPLICATION

This application claims subject matter set forth in Provisional Application Ser. No. 60/028,130, filed Oct. 15, 1996, entitled MEN'S UNDERWEAR BOXER SHORTS WITH INTEGRATED SUPPORT BRIEF.

BACKGROUND OF THE INVENTION

1. Field of the Invention

The invention relates to male underwear; and, more particularly, to male boxer shorts with inner integrated male briefs.

2. Background Information

Many men and women like the external appearance of boxer shorts. Such shorts are adaptable to variations in colors, patterns, etc. However, boxer shorts do not provide support for the male anatomy. Many men wear briefs for this purpose. Such briefs do in fact support the male anatomy and, although some briefs now come in colors and various patterns, the majority are usually of unadorned and plain white cotton material. Some sport shorts and swim suits have inner mesh liners which give little if any support. Further, certain briefs may not be attractive to some women.

There is a need for a male undergarment which combines the style and look of boxer shorts with the added benefit of support of the male anatomy by briefs not visible from the exterior of the boxer shorts.

SUMMARY OF THE INVENTION

It is an object of this invention to provide a male undergarment having the external appearance of boxer shorts with inner familiar support for the male anatomy.

It is an object of this invention to carry out the foregoing object by utilizing a single waistband having integral male boxer shorts on the exterior and an integral male brief on the interior.

These and other objects are preferably accomplished by providing boxer shorts for men having internal integrated male briefs not visible from the exterior. The briefs are sewn inside the shorts and both are integral with a single waistband. The look of boxer shorts is provided with the added benefit of built-in male briefs for supporting the male anatomy.

DESCRIPTION OF THE PREFERRED EMBODIMENT

Figure 1:
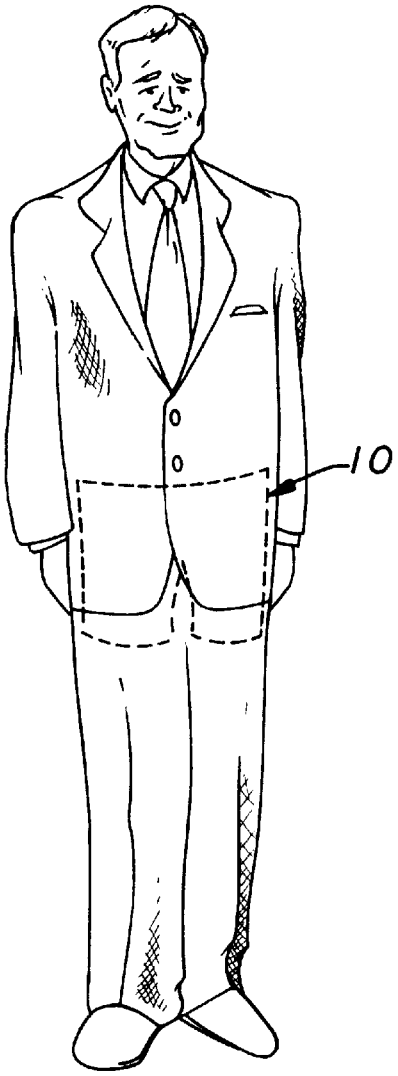
FIG. 1 is a front view of a male wearing male boxer shorts with an integrated male briefs in accordance with the teachings of the invention.
Figure 2:
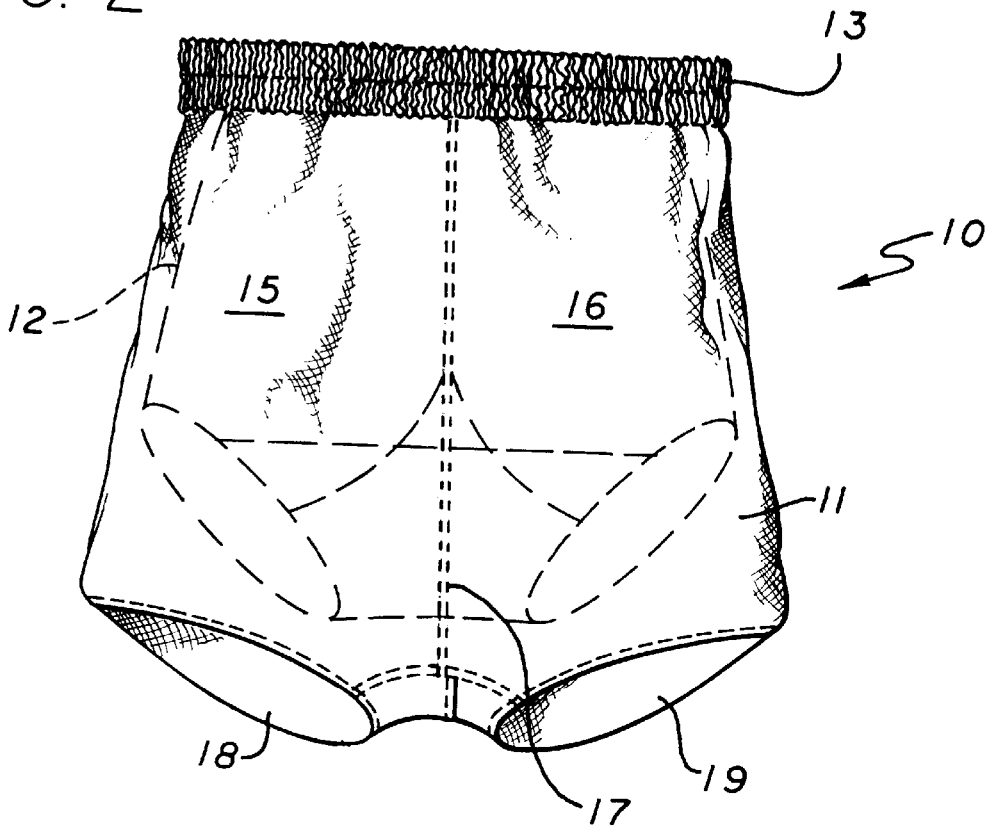
FIG. 2 is a front view of the boxer shorts of FIG. 1.

Referring now to FIG. 1 of the drawing, a male is shown wearing male underwear in the form of garment 10 (in dotted lines). Garment 10 (FIG. 2) has outer male boxer shorts 11 and inner male briefs 12 (see also FIG. 3). Both boxer shorts 11 and male briefs 12 are integral with a waistband 13 (FIG. 2).

Figure 4:
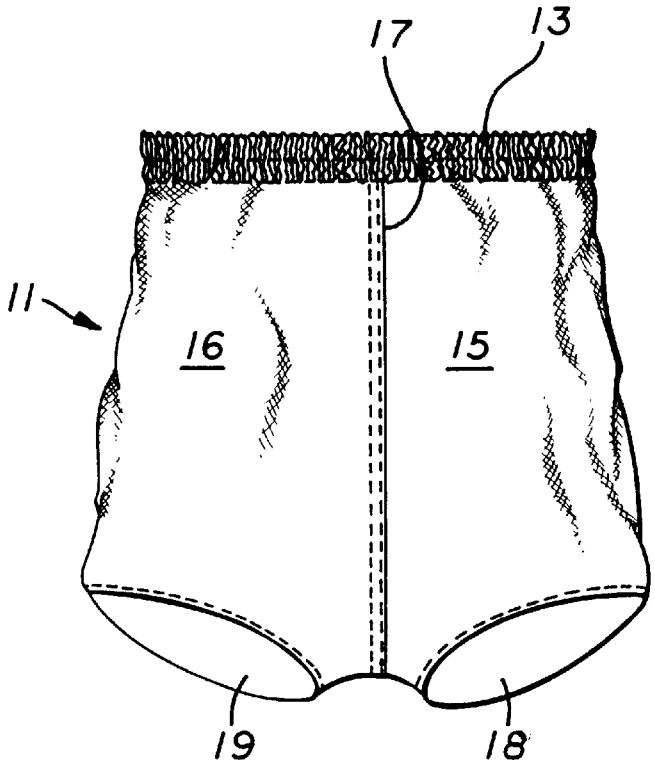
FIG. 4 is a rear view of the boxer shorts of FIG. 1.

Boxer shorts 11 have a pair of panels 15, 16 joined along a seam line 17 which may extend from waistband 13 downwardly and along the rear (FIG. 4) back to waistband 13. A pair of leg openings 18, 19 are thus formed in boxer shorts 11.

Figure 3:
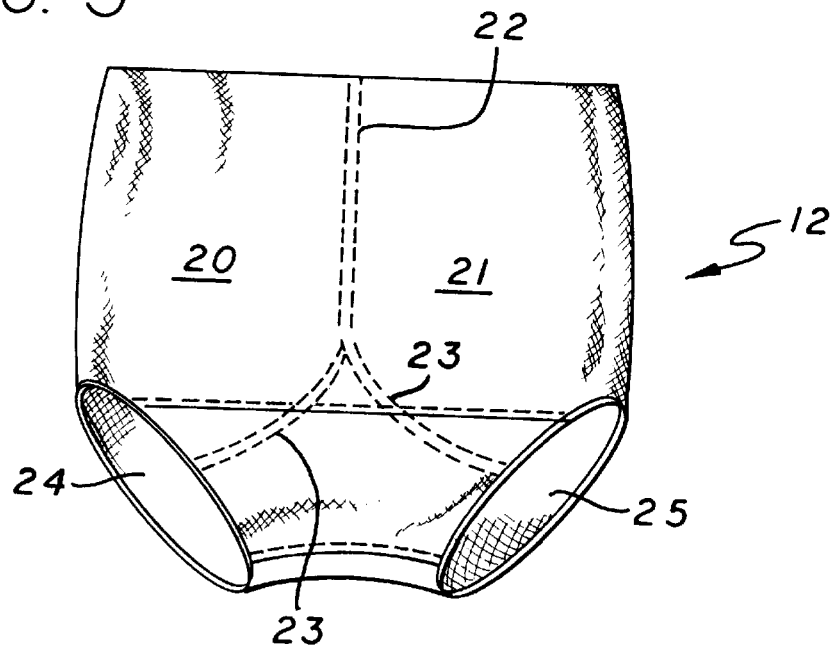
FIG. 3 is a front view of the briefs alone of FIG. 1 shown detached from the shorts of FIG. 1.

Waistband 13 is of elastic material to adapt to one's waist. As particularly contemplated in the present invention, a man's support brief 12 (FIG. 3) is integral with the boxer shorts 11 by being sewn or stitched or otherwise integral with waistband 13 (FIG. 2) and extending downwardly therefrom. As seen in FIG. 3, brief 12 has a pair of panels 20, 21 stitched along seams 22, 23 forming an integral garment having leg openings 24, 25.

There is thus disclosed a men's underwear garment in the form of a pair of boxer shorts combined with sewn-in underwear briefs. This combines the look of boxer shorts with the added benefit of built-in "invisible" briefs which offer better support for the male anatomy.

Any suitable male boxer shorts may be used, of any suitable material, such as cotton, silk, nylon, or any other fabric. Either a standard or "low rise" brief design, with a no-fly front, may be used. The briefs and the boxer shorts are assembled by placing the briefs inside the boxer shorts and either hand or machine sew the briefs to the waistband of the boxer shorts about its circumference. This of course can be done by providing a single waistband at the initial stages of manufacturing. Alternatively, the waistband of one garment may be sewn to the waistband of the other garment thus forming a single integral waistband. In any event, the boxer shorts and briefs are permanently sewn together only at the waist and not joined anywhere else.

Thus, as seen in FIG. 1, a male may wear the boxer shorts 10 underneath his regular pants. When the regular pants are removed, the garment in FIG. 2 presents the outer appearance of a conventional pair of boxer shorts. However, the inner brief supports the male anatomy.

Research has shown that women generally prefer the look of boxer shorts on men, and a single underwear garment is disclosed satisfying both the woman's desire for an aesthetically pleasing undergarment and the man's need or desire for anatomical support.

Although a particular embodiment of the invention is disclosed, variations thereof may occur to an artisan and the scope of the invention shown may only be considered to be limited by the scope of the appended claims.

I claim:

1. A man's undergarment adapted to be worn underneath a pair of trousers or the like comprising:

a pair of man's boxer shorts having a waistband; and a man's undergarment support brief structure including a body portion with an upper edge; said upper edge being connected to said boxer shorts waistband disposed on an interior of said boxer shorts extending downwardly from said waistband and not visible from an exterior of said boxer shorts, wherein said boxer shorts and said brief share said waistband.

2. The undergarment of claim 1 wherein said waistband is of elastic material.

3. The undergarment of claim 1 wherein said support brief body portion is connected to said boxer shorts only at said waistband.

4. A man's clothing outfit including an undergarment adapted to be worn underneath a pair of trousers or the like comprising:

a pair of men's trousers;

a pair of man's boxer shorts having a waist band disposed under said trousers; and a man's undergarment support brief structure including a body portion with an upper edge; said upper edge being connected to said boxer shorts waistband disposed on an interior of said boxer shorts extending downwardly from said waistband and not visible from an exterior of said boxer shorts, wherein said boxer shorts and said brief share said waistband.

5. A man's undergarment comprising:

a pair of man's boxer shorts undergarment having a pair of panels joined along a seam forming an open top encircled by a waistband and a pair of leg openings remote from said waistband; and a man's support brief undergarment having a pair of panels joined along a seam forming an open top with an upper edge and a pair of leg openings remote from said waistband, said upper edge is connected to the waistband disposed on an interior of said boxer shorts extending downwardly from said waistband and not visible from an exterior of said boxer shorts and secured to said boxer shorts only at said waistband, wherein said boxer shorts and said brief share said waistband.

6. A method of wearing a pair of trousers or the like and an undergarment, the method comprising the steps of:

providing an undergarment comprising a pair of men's undergarment boxer shorts having a waistband disposed under said pair of trousers and a man's undergarment support brief having an upper edge connected to said waistband disposed on an interior of said boxer shorts extending downwardly from said waistband and not visible from an exterior of said boxer shorts; and placing said undergarment on a wearer and placing said pair of trousers over said undergarment on said wearer.

* * * * *